US006810988B2

(12) United States Patent
Chan

(10) Patent No.: US 6,810,988 B2
(45) Date of Patent: Nov. 2, 2004

(54) SPEAKER'S DAMPER WITH LEAD WIRE AND GUIDE SLEEVE

(76) Inventor: Yen-Chen Chan, No. 120, Min An East Road, Hsin Chuang City, Taipei Hsien (TW)

( * ) Notice: Subject to any disclaimer, the term of this patent is extended or adjusted under 35 U.S.C. 154(b) by 32 days.

(21) Appl. No.: 10/308,413

(22) Filed: Dec. 2, 2002

(65) Prior Publication Data

US 2004/0104070 A1 Jun. 3, 2004

(51) Int. Cl.[7] ..... H04R 7/00
(52) U.S. Cl. ..... 181/171
(58) Field of Search ..... 181/171, 172, 181/173, 174, 148, 151, 153, 166, 169

(56) References Cited

U.S. PATENT DOCUMENTS 5,757,945 A * 5/1998 Sakamoto ..... 381/400
5,878,150 A * 3/1999 Okazaki et al. ..... 381/428
6,626,262 B1 * 9/2003 Chen ..... 181/149
6,691,832 B2 * 2/2004 Moritake et al. ..... 181/153

* cited by examiner

*Primary Examiner*—Kimberly Lockett

(57) ABSTRACT

A speaker's damper is comprised of a main body and lead wires, in which the damper's main body is essentially a piece of woven cloth pressed in the form of an annular disk with a corrugated cutaway section while the lead wire is a metallic wire in texture properly interwoven in the damper's main body so that the jumping-rope phenomenon of the lead wire can be avoided when the damper's main body is in vibration. The lead wire is securely attached to the main body on the woven cloth and beneath a plurality of lifted-up cloth segments. Also, by means of a guide sleeve, two lead wires can be prevented from being short-circuited during vibration of the dampers main body.

1 Claim, 4 Drawing Sheets

SPEAKER'S DAMPER WITH LEAD WIRE AND GUIDE SLEEVE

FIELD OF THE INVENTION

The present invention pertains to a speaker's damper, and more specifically to a speaker's damper with lead wire and guide sleeve.

BACKGROUND OF THE INVENTION

A damper for exclusive application to a generic speaker so far is disposed between the main body and the drum paper of the speaker, in which an external signal is provided to a signal terminal on the main body, then transmitted to the drum paper through a lead wire suspended over the damper. Therefore, because of the speaker's construction like this, the lead wire is liable to be ruptured to incur a signal's interruption when the speaker is dismounted. The jumping-rope phenomenon of the suspended lead wire may also cause the lead wire to break or short circuit as the damper outputs power and vibrates.

SUMMARY OF THE INVENTION

To overcome the above-mentioned drawbacks of a conventional speaker damper, the inventor is to provide a speaker's damper combined with a lead wire, whereby the lead wire cannot be ruptured easily or short-circuited between two wires just because of vibrating or dragging. The damper of this invention is comprised of a main body and lead wires, in which the damper's main body is essentially a piece of woven cloth pressed in the form of an annular disk with a corrugated cutaway section while the lead wire is a metallic wire in texture properly interwoven in the damper's main body so that the jumping-rope phenomenon can be avoided when the damper's main body is in vibration. In addition, by means of a guide sleeve, two lead wires can be prevented from being short-circuited during vibration of the damper's main body.

The merits of the speaker's damper may be summarized as the following by performing this invention:

(1) The broken rate of the lead wire can be lowered significantly;

(2) The jumping-rope phenomenon and hence the incurred rupture of the lead wire can be avoided; and (3) The short-circuit of two lead wires can be avoided.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
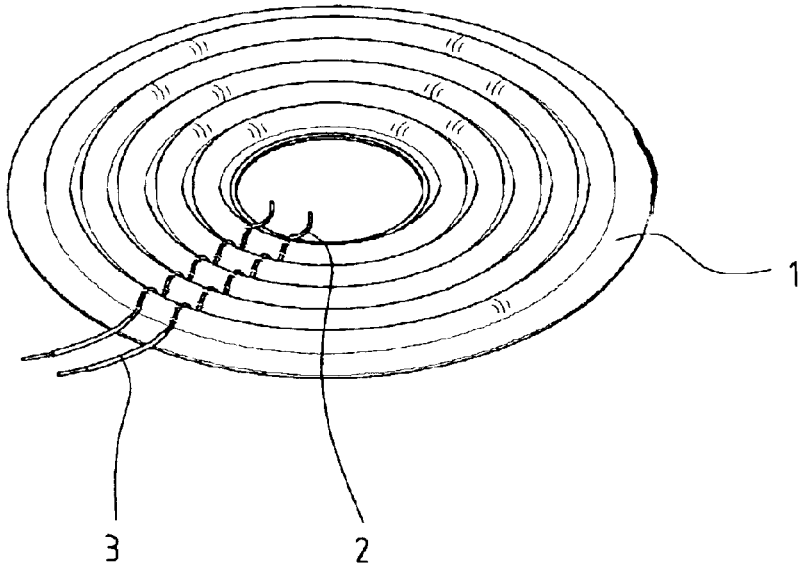
FIG. 1 is a perspective view of this invention.
Figure 2:
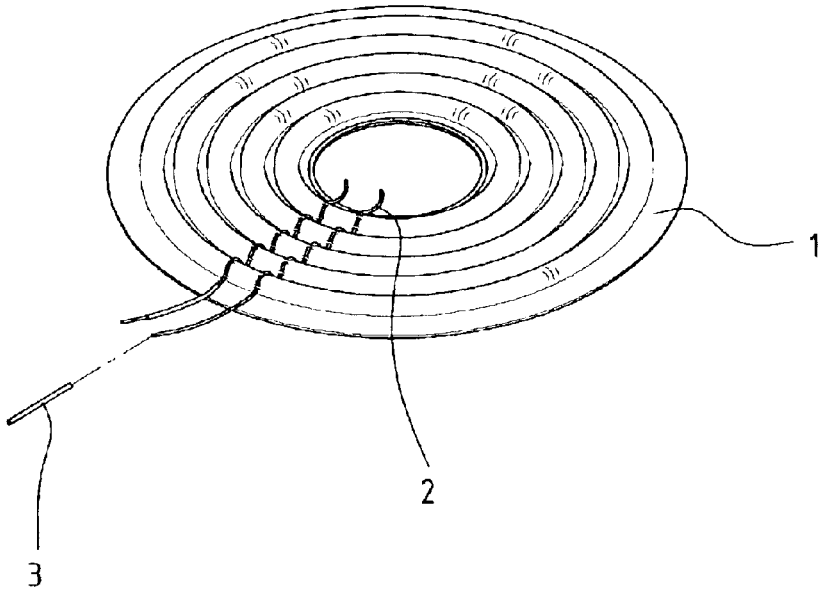
FIG. 2 is an exploded partial view in three dimensions of this invention.

With reference to a perspective view (FIG. 1) and an exploded partial view (FIG. 2) enclosed, a speaker's damper with lead wire and guide sleeve of this invention shown in these figures is comprised of a main body 1 and a plurality of lead wires 2 and guide sleeves 3.

The damper's main body 1 is essentially a piece of woven cloth pressed in the form of an annular disk with a corrugated cutaway section. The lead wire 2 is a metallic wire in texture properly interwoven in the damper's main body 1 so that the so-called jumping-rope phenomenon can be avoided when the damper's main body 1 is in vibration. Moreover, the portion of the lead wire 2 that projects our of the damper's main body 1 is sheathed with a guide sleeve made of an insulation material in a tubular configuration. By means of the guide sleeve 3, the projected portion of the lead wires 2 out of the dampcr's main body 1 can be hence prevented from being short-circuited or ruptured by vibration.

Figure 3:
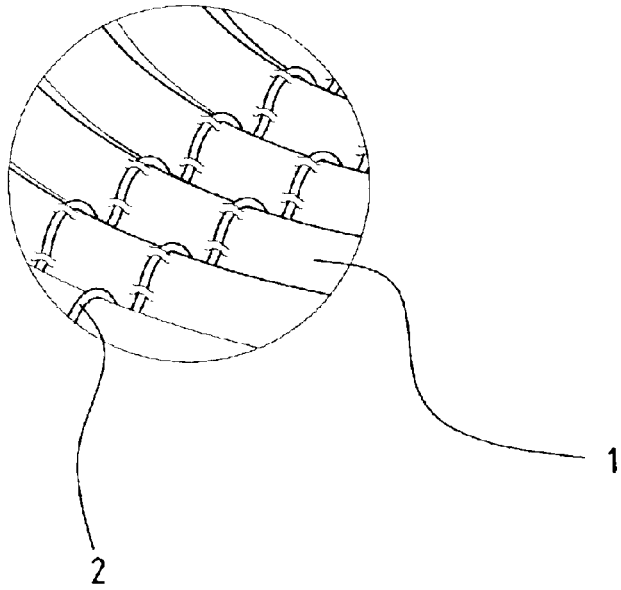
FIG. 3 is an enlarged partial view of the damper of this invention.
Figure 4:
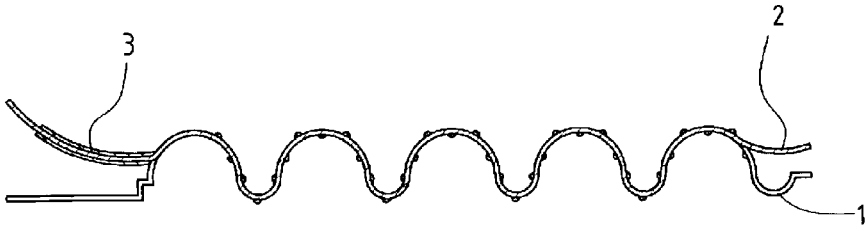
FIG. 4 is a cutaway sectional view of the damper of this invention.

An enlarged partial view and a cutaway sectional view of the damper of this invention are shown in FIG. 3 and FIG. 4. As indicated in FIGS. 3 and 4, there is a damper's main body 1 of woven cloth configured in the form of an annular disk with a corrugated cutaway section, in which a lead wire 2, substantially a metallic wire in texture for receiving an external signal to a speaker's voice coil, is properly interwoven in the damper's main body 1 so that the jumping-rope phenomenon of the lead wire 2 and accordingly the rupture thereof can be prevented when the damper's main body 1 vibrates. As can be seen from FIG. 3, the lead wires are interwoven with the damper's cloth in such a way that the lead wire is disposed below a plurality of lifted-up segments of the damper's cloth to tie the lead wire to the damper. With such arrangement, the lead wire is securely attached to the speaker damper and can not jump around when the damper vibrates.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A speaker damper with lead wires and guide sleeves, comprising:

a damper main body formed by a piece of woven cloth pressed in the form of an annular disk with a corrugated cross section, said woven cloth having a corrugated surface and a plurality of lifted-up cloth segments;

a plurality of lead wires interwoven with said damper main body, each lead wire being disposed on said corrugated surface and beneath a number of said lifted-up cloth segments; and a plurality of guide sleeves made of an insulation material, each guide sleeve being fit over an end of a lead wire projected out of said damper main body.

* * * * *